US005216744A

United States Patent [19]

Alleyne et al.

[11] Patent Number: 5,216,744

[45] Date of Patent: Jun. 1, 1993

[54] TIME SCALE MODIFICATION OF SPEECH SIGNALS

[75] Inventors: Charles C. Alleyne, West Haven; Kevin J. Bruemmer, Southington, both of Conn.

[73] Assignee: Dictaphone Corporation, Stratford, Conn.

[21] Appl. No.: 673,042

[22] Filed: Mar. 21, 1991

[51] Int. Cl.[5] ..... G10L 9/04

[52] U.S. Cl. ..... 395/2

[58] Field of Search ..... 381/29-40, 381/49, 51-52; 395/2

[56] References Cited

U.S. PATENT DOCUMENTS

| | | | |
|---|---|---|---|
| 3,104,284 | 9/1963 | French et al. | 179/15.55 |
| 3,369,077 | 2/1968 | French et al. | 381/38 |
| 4,435,832 | 3/1984 | Asada et al. | 381/34 |
| 4,631,746 | 12/1986 | Bergerson et al. | 381/35 |
| 4,709,390 | 11/1987 | Atal et al. | 381/38 |
| 4,864,620 | 9/1989 | Bialick | 381/34 |
| 4,890,325 | 12/1989 | Taniguchi et al. | 381/34 |
| 4,989,246 | 1/1991 | Wan et al. | 395/2 |

OTHER PUBLICATIONS

B. Gold and L. Rabiner; "Parallel Processing Techniques for Estimating Pitch Periods of Speech in the Time Domain"; J. Acoust. Soc. Am., vol. 46, pp. 442-448, Aug. 1969.

L. R. Rabiner et al.; "A Comparative Performance Study of Several Pitch Detection Algorithms"; IEEE Transactions on Acoustics, Speech and Signal Processing, vol. ASSP-24, No. 5, Oct. 1976, pp. 399-418.

E. P. Neuberg; "A Simple Pitch-Dependent Algorithm for High-Quality Speech Rate Changing"; (abstract) J. Acoust. Soc. Am. vol. 61, Supp. 1 (1977), pp. 1-15.

Malah; "Time-Domain Algorithms for Harmonic Bandwidth Reduction and Time Scaling of Speech Signals"; IEEE Transactions on Acoustics, Speech, and Signal Processing; vol. ASSP-27, No. 2, Apr. 1979, pp. 121-133.

Cox et al; "Real Time Implementation of Time Domain Harmonic Scaling of Speech for Rat Modification and Coding"; IEEE Transactions on Acoustics, Speech, and Signal Processing; vol. ASSR-31, No. 1, Feb. 1983, pp. 258-271.

Roucos et al; "High Quality Time-Scale Modification for Speech"; Proceedings of IEEE International Conference on Acoustics, Speech and Signal Processing, 1985, vol. 2; pp. 493-496.

Makhoul et al.; "Time-Scale Modification in Medium to Low Rate Speech Coding"; Proceedings of IEEE International Conference on Acoustics, Speech and Signal Processing, 1986, vol. 3, pp. 1705-1708.

*Primary Examiner*—Allen R. MacDonald
*Assistant Examiner*—Michelle Doerrler
*Attorney, Agent, or Firm*—Peter Vrahotes; Melvin J. Scolnick

[57] ABSTRACT

For speech signals that represent a wave form and include a sequence of samples, a method is provided for modifying the time scale of the speech signals. The method includes estimating the number of the samples that constitutes a pitch period. The estimate is made by a plurality of pitch estimators that operate in parallel and process peak and/or valley measurements of the wave form. The method also includes combining a first group of samples with a second group of samples to form a combined group. Each group consists of the same number of sequential samples from the sequence of samples. The number of samples in each group is equal to the estimated number of samples that constitutes a pitch period. The second group of samples immediately follows the first group in the sequence of samples. According to another feature of the invention, the method includes determininq whether the time scale of the speech signals is to be compressed or expanded. If the time scale is to be compressed a combined group is periodically reproduced instead of the first and second groups. If the time scale is to be expanded, a combined group is periodically reproduced after reproducing the first group and before reproducing the second group.

17 Claims, 8 Drawing Sheets

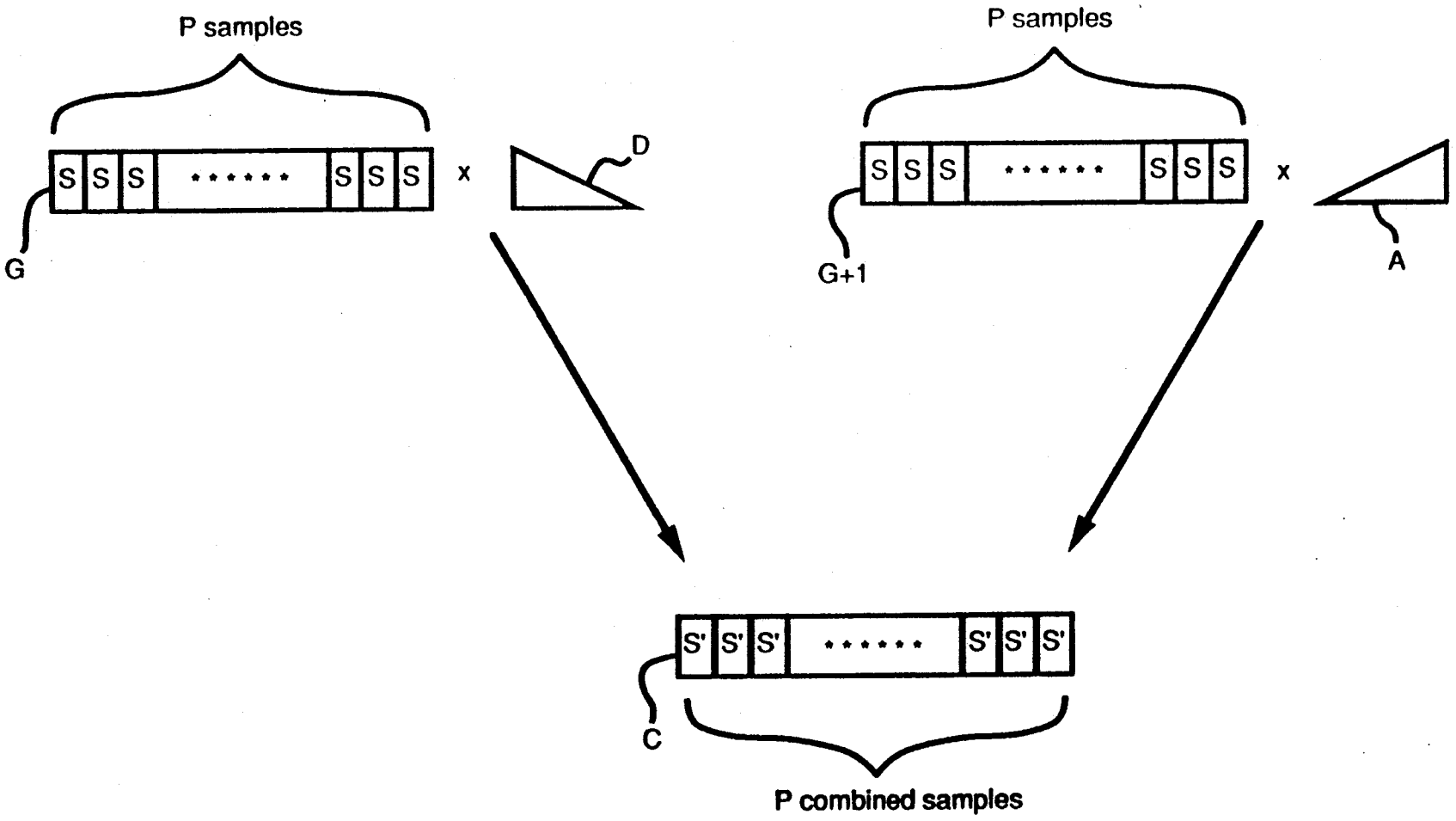
FIG. 6-A

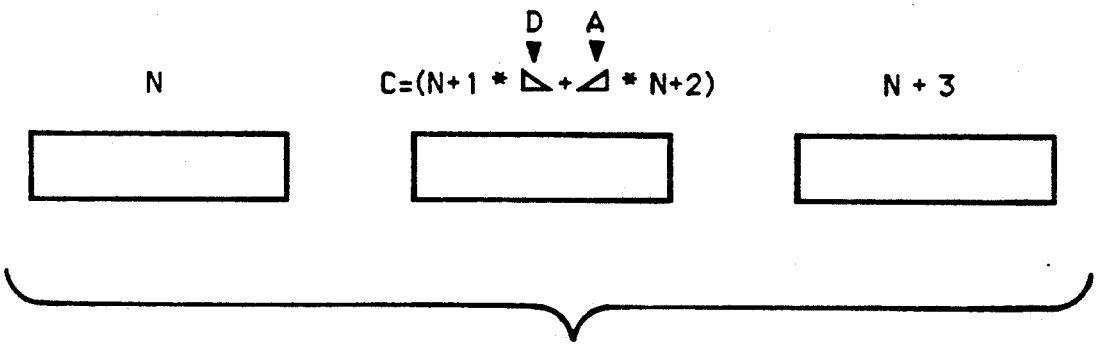
FIG. 6-B
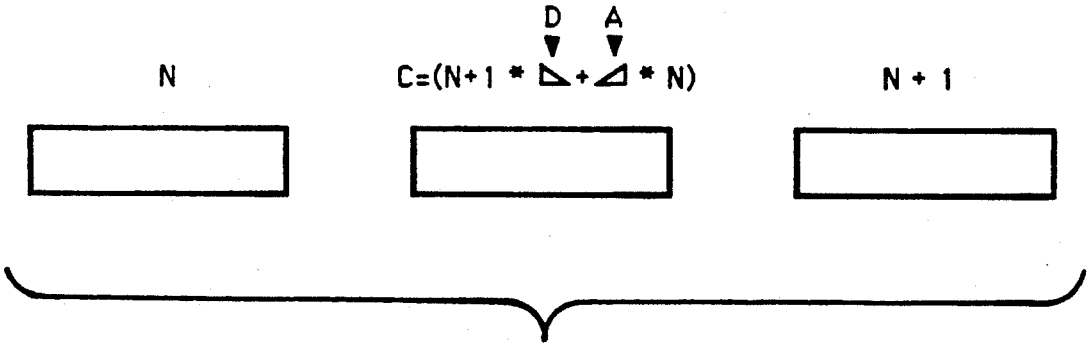
FIG. 6-C

TIME SCALE MODIFICATION OF SPEECH SIGNALS

FIELD OF THE INVENTION

This invention relates to processing of digital speech signals and more particularly to modification of the time scale of reproduction of the speech represented by the signals.

BACKGROUND OF THE INVENTION

There have been proposed many methods of speeding up or slowing down the rate of reproduction of recorded speech. It has also been desired to avoid the change in pitch that accompanies the simple speeding up or slowing down of playback of a conventional analog tape recording.

Storage of speech in the form of digital samples has led to a number of proposals that utilize digital signal processing techniques for time-scale modification. Among these are Cox et al., "Real-Time Implementation of Time Domain Harmonic Scaling of Speech for Rate Modification and Coding", IEEE Transactions on Acoustics, Speech, and Signal Processing, Vol. ASSP-31, No. 1, pp. 258–271, February, 1983; U.S. Pat. No. 4,864,620, issued to Bialick; Malah, "Time-Domain Algorithms for Harmonic Bandwidth Reduction and Time Scaling of Speech Signals", IEEE Transactions on Acoustics, Speech, and Signal Processing, Vol. ASSP-27, No. 2, pp. 121–133, April 1979; U.S. Pat. No. 3,104,284, issued to French et al.; Neuberg, "A Simple Pitch-Dependent Algorithm For High-Quality Speech Rate Changing" (abstract), Journal of the Acoustical Society of America 61, Suppl. 1 (1977). However, the neet has remained for time-scale modification that provides tetter quality reproduction and/or more efficient processing, use of memory, and so forth.

SUMMARY OF THE INVENTION

For speech signals that represent a wave form and include a sequence of samples, a method is provided, according to the invention, for modifying the time scale of the speech signals. The method includes storing the sequence of samples in a memory, retrieving the samples from the memory and estimating the number of the samples that constitutes a pitch period. A group of samples representing a pitch period is reproduced. Then a first group of samples is combined with a second group of samples to form a combined group. Each group consists of the same number of sequential samples from the sequence of samples. The number of samples in each group is equal to the estimated number of samples that constitutes a pitch period. The second group of samples immediately follows the first group in the sequence of samples. The combined group is then reproduced.

According to a further aspect of the invention, at certain times during expansion of the time scale, the step of estimating the pitch period is accelerated by using every other sample of the sequence for the measurements.

BRIEF DESCRIPTION OF THE DRAWINGS

FIGS. 6-A, 6-B, 6-C are schematic illustrations of parts of the programs of FIG. 4 or FIG. 5 in which two groups of speech signal samples are combined to form a combined group of samples.

DETAILED DESCRIPTION OF THE INVENTION

Figure 1:
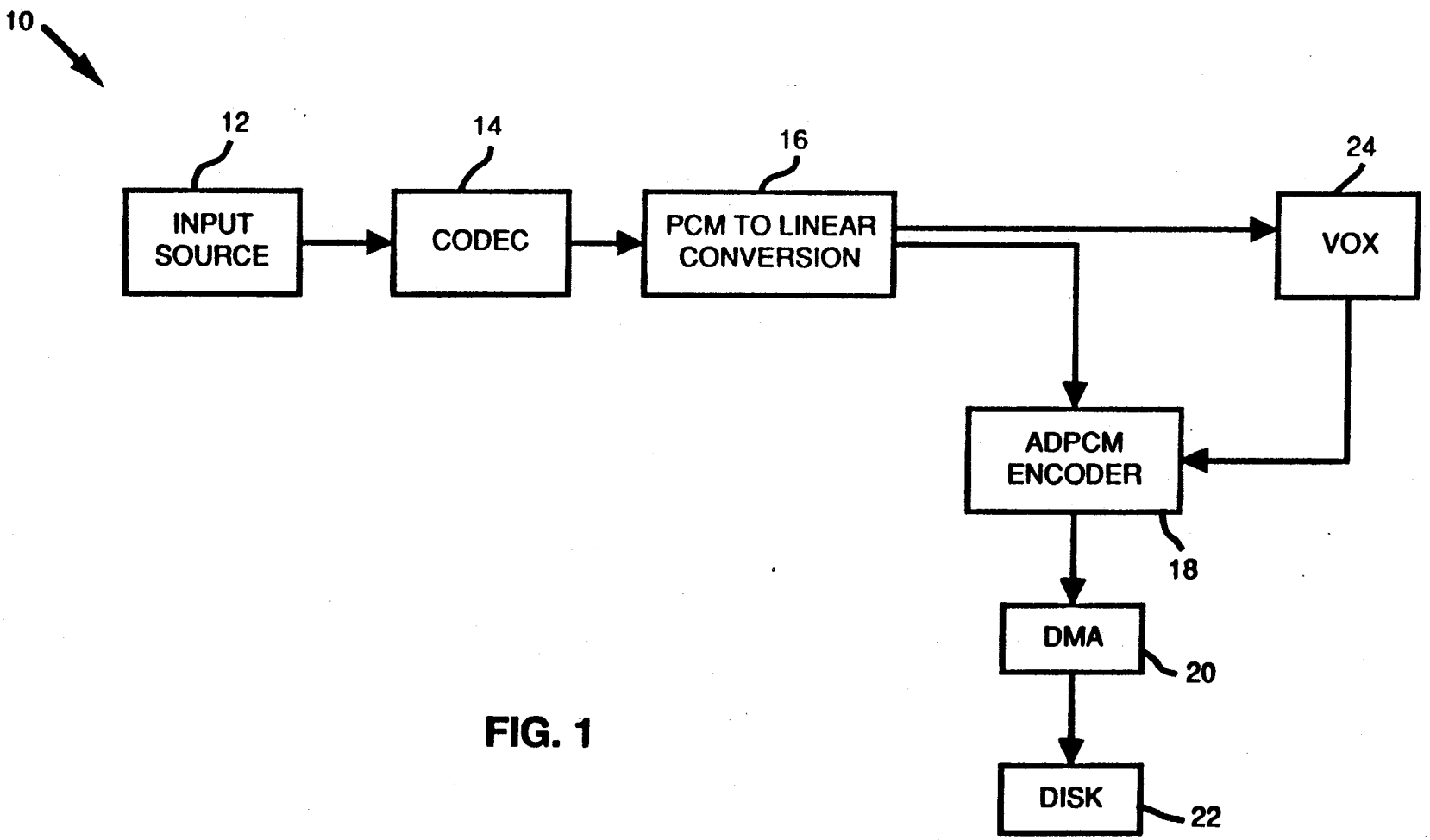
FIGS. 1 and 2 are functional block diagrams of a recording and playback apparatus which operates in accordance with the invention.

FIG. 1 illustrates, in the form of a functional block diagram, record and playback apparatus 10 as it operates the recording mode. Apparatus 10 includes a source 12 of analog speech signals that are to be recorded by apparatus 10. Souroe 12 may be, for example, a ocnventional diotatinq station, microphone, or interface to a telephone circuit. Connected to source 12 is codec device 14, which receives analog speech signals from source 12 and translates the analog signals into digital pulse code modulated (PCM) samples. Codec device 14 may be, for example, a model PDμ9516A available from NEC Electronics Inc., Mountain View, Calif. Codec device 14 samples the speech signals at a sampling rate of 8,000 hz and filters the speech wave form represented by the analog signals to attenuate frequencies above 3400 hz, producing an 8 bit PCM output sample every 125 microseconds, for a data rate of 64 kilobits per second. Connected to codec 14 is conversion module 16 which converts the PCM samples output by codec 14 into their linearized 14 bit equivalents in accordance with well known CCITT recommendation G.711. Adaptive differential pulse code modulated (ADPCM) encoder module 18 is connected to conversion module 16 and converts the 14 bit linear signals output by module 16 into 4- bit quantized errors signal. ADPCM encoding of PCM signals is well known and need not be discussed in detail. Both modules 16 and 18 may be conveniently realized, for example, by use of the model 77P25 digital signal processing (DSP) integrated circuit available from NEC Electronics Inc., operating under the control of a suitable stored program. Provision of a program to perform the functions of module 16 and 18 is well known to those skilled in the art.

Four bit ADPCM samples produced by encoder module 18 are paired to form 8 bit words which are transferred from module 18 to direct memory access (DMA) interface 20. The 8 bit words (each containing two 4 bit ADPCM samples) are then transferred from DMA interface 20 to disk storage 22. DMA interface 20 may be realized, for irstance, by a model μPP71071 available from NEC Electronics Inc. Disk storage 22 may be a conventional stand alone device or part of a conventional personal computer.

Voice operated switch (VOX) device 24 is functionally connected to modules 16 and 18. The purpose of VOX 24 is to conserve storage space on disk 22 by not storing silence or useless noise signals. VOX 24 monitors the output of module 16 and inhibits recording of signals except when speech is present. Implementation of VOX 24 is well known to those skilled in the art.

Figure 2:
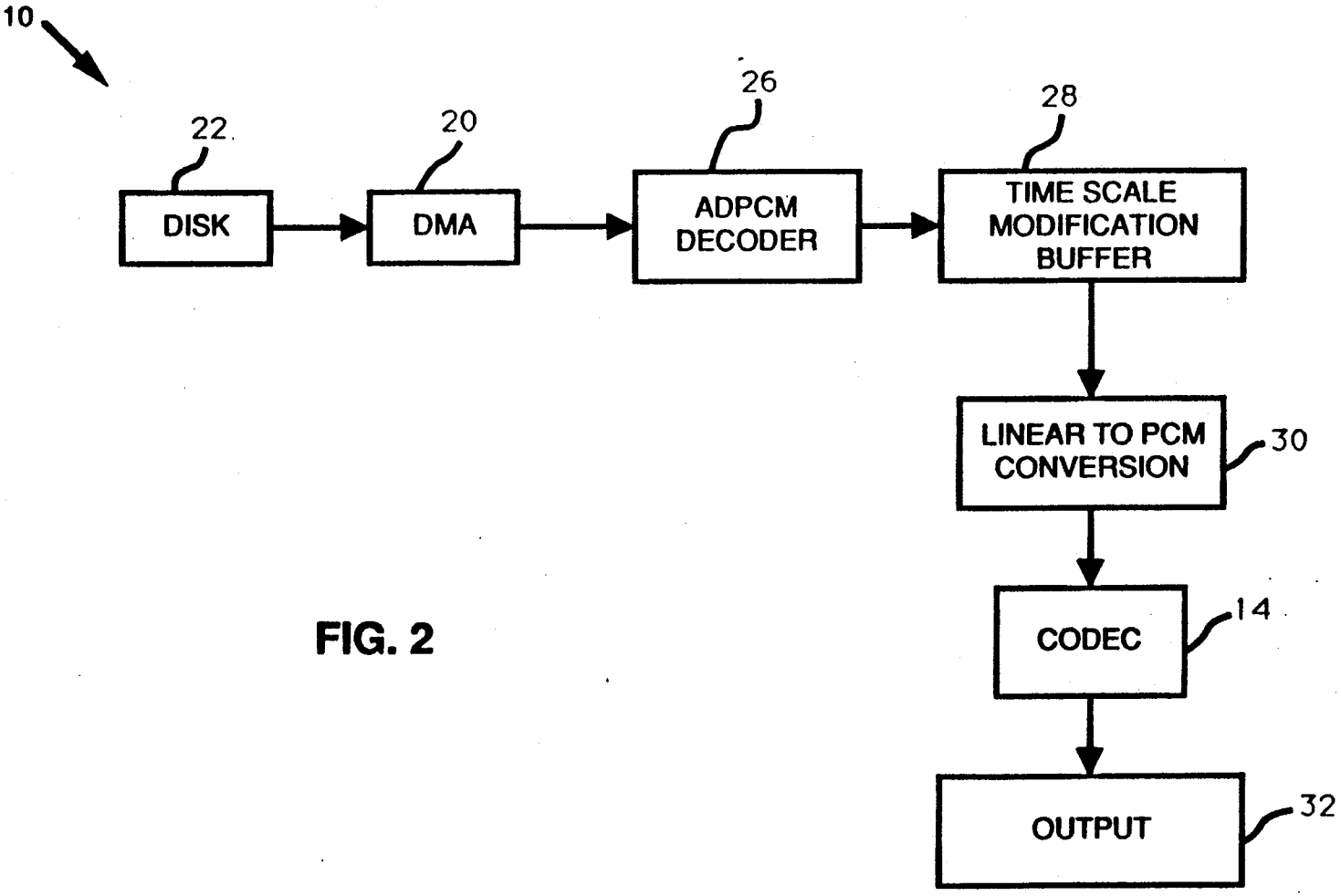

FIG. 2 shows a functional block diagram for apparatus 10 when it is operated to playback speech signals that have been stored on disk 22.

As previously described, the signals stored on disk 22 are 8 bit words each consisting of two 4 bit ADPCM encoded samples. These words are transferred from disk 22 to DMA 20 and then from DMA 20 to ADPCM decoder module 26. Decoder module 26 produces a 14 bit reconstructed linearized sample from each 4 bit ADPCM sample that it receives from DMA 20. The linear samples are then passed to time scale modification and buffer module 28 for either sequential reproduction, if no time scale modification is requested, or for modification and reproduction at a modified playback rate requested by the user of apparatus 10.

Whether or not modified by time scale modification module 28, the linear samples are then transferred to linear to PCM conversion module 30 for conversion to PCM samples.

PCM samples output by module 30 are received by codec 14 for decoding into analog signals that are then output through output device 32, which may be a conventional transcribing station, telephone circuit, or speaker.

Modules 26, 28 and 30 may all be realized in a single DSP, such as the above mentioned model 77P25. Software implementation of modules 26 and 30 is well within the capability of those skilled in the art. A program to implement module 28 is discussed below.

Figure 3:
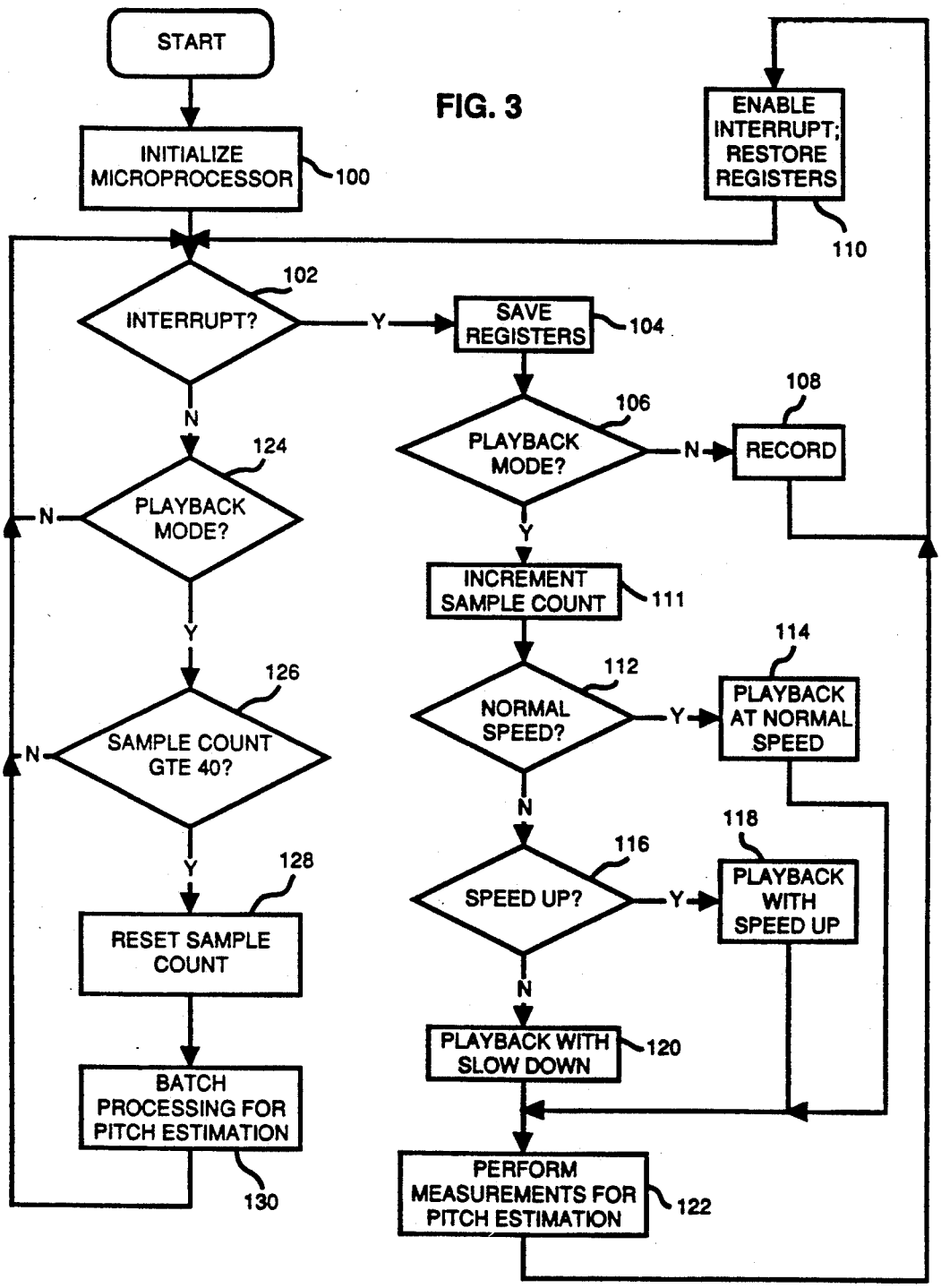
FIG. 3 is a flowchart that illustrates a main program for operating a digital signal processing device in accordance with the invention.

FIG. 3 is a flowchart illustrating a main line program for time scale modification and buffering of speech signals.

The program of FIG. 3 begins with step 100, at which the processor running the program is initialized. Initialization may include such steps as initializing register values, initializing variables and handshaking with a host processor. As noted above, a preferred processor to run the program of FIG. 3 is the NEC 77P25, but it should be understood that any programmable processor can be used. Following step 100 is step 102, at which it is determined whether an interrupt has l,een actuated. In a preferred method of carrying out this invention, an interrupt will be actuated every 125 micro seconds during record or playback operation of apparatus 10.

Assuming at step 102 an interrupt had been actuated, register values are saved (step 104), ard it is then determined whether apparatus 10 is in playback mode (step 106). If at step 106 it was found that apparatus 10 is not in playback mode, step 108 follows, at which voice signals are recorded. Next follows step 110, at which an interrupt is enabled and the register values are restored. Another interrupt is then awaited.

If at step 106 is determined that the apparatus is in playback mode, step 111 follows, at which the sample count is incremented. The purpose of the sample count will be discussed below. Following step 111 is step 112, at which it is determined whether the playback is to be at normal speed. If so, step 114 follows, at which the speech signal stored on disk 22 are reproduced through output device 32 at normal speed; i.e. without time scale modification.

If at step 112 it was determined that playback was not to be at normal speed, step 116 follows, at which it is determined whether the time scale modification of the speech signals is to consist of speeding up the time scale. If so, step 118 follows, in which the speech signals are reproduced with the time scale speeded up. If at step 116 it is determined that the time scale was not to be speeded up, step 120 follows, in which the speech signals are reproduced with the time scale slowed down.

Following either step 114, 118 or 120, as the case may be, is step 122, at which a number of measurements are performed for the purpose of estimating the pitch period of the speech signals. Pitch period estimation by apparatus 10 will be discussed in more detail below.

Next following step 122 is step 110, which has been discussed above, and step 102 again follows step 110.

Returning then to step 102, if it is determined at that step that an interrupt has not been actuated, then step 124 follows at which it is determined whether apparatus 10 is in playback mode. If not, the program returns again to step 102. If so, the program proceeds to step 126, at which it is determined whether the sample count is greater than or equal to 40. If not, the program again returns to step 102. If so, step 128 follows, at which the sample count is reset to zero and step 130 then follows. At step 130, measurements that have previously been made for the purpose of pitch estimation are processed so as to determine an estimated pitch period for the speech samples. As will be discussed in more detail, the estimate is expressed in the number of samples making up a pitch period. The batch processing (step 130) required to arrive at an estimated pitch period takes considerably longer than 125 micro seconds and thus is periodically interrupted each time an interrupt is actuated. When an interrupt is actuated the program returns to step 102 and branches to steps 104 and the following steps as previously described. It should also be understood that the program returns to step 102 upon completion of the batch processing for pitch estimation (step 130).

Steps 118 and 120 of FIG. 3, relating to reproduction of speech signals with speeding up or slowing down of the signals' time scale, will now be described in greater detail with reference to FIGS. 4 and 5.

The overall approach of the routine of FIG. 4 may be summarized as follows:

Two adjacent groups of samples, each consisting of the number of samples making up a pitch period, are combined to form a combined group of that same number of samples. The combined group is then reproduced in place of the two groups of samples from which it was formed. The effect of is process is to reduce to 50% the amount of time that would otherwise have been required to reproduce the two groups of samples. Accordingly, one can say that a scaling factor of 0.5 had been applied to the time scale of the two groups of samples.

A higher scaling factor, representirg a somewhat less speeded up time scale, can be achieved by, for instance, reproducing a group of samples at a normal rate, and then combining the next two groups and reprcducing their combined group of samples in their place. By continuously alternating between normal reproduction and then combination of the next two groups and reproduction of the combined group in place of the next two groups, one achieves a scaling factor of 0.666. Other scaling factors, representing still smaller degrees of speeding up can be achieved by increasing the number of groups that are normally reproduced between substitutions of a combined group for an adjacent pair of groups. Accordingly, as a further example, if two groups are normally reproduced, then the next two combined and the combined group substituted in their place, then two groups normally reproduced, and the next two combined with substitution of the combined group, and so forth, the result is a scaling factor of 0.75. In a preferred approach to this invention, the following speed up scaling factors are made available to a user of apparatus 10: 0.666 ($\frac{2}{3}$), 0.75 ($\frac{3}{4}$), 0.8 (4/5), 0.833 (5/6), 0.857 (6/7), 0.875 (7/8). When a scaling factor of less than 1.0 is applied to the stored speech signals it may be said that the time scale of the signals has been "compressed".

Figure 4:
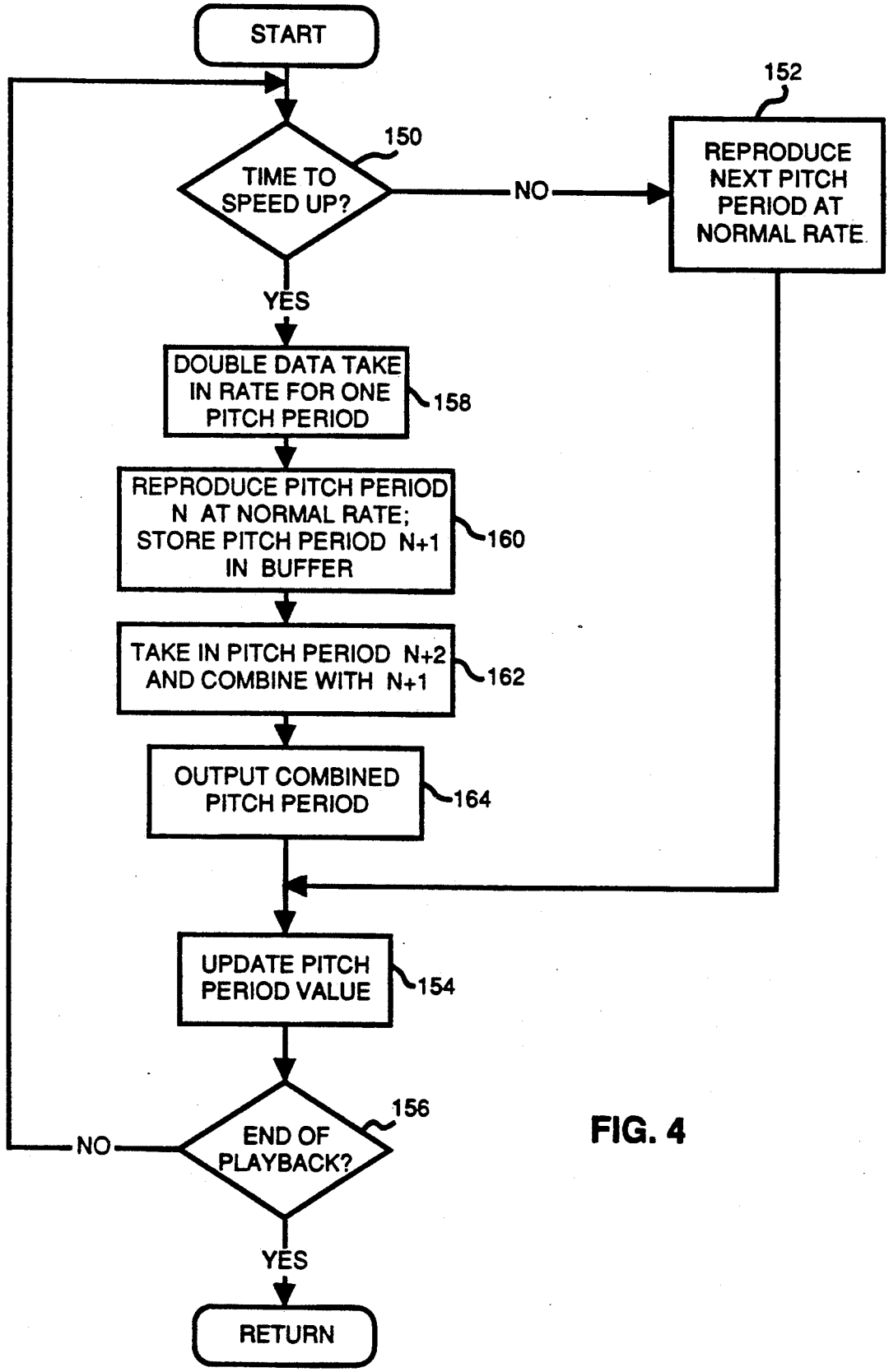
FIG. 4 is a flowchart illustrating a program for speeding up the time scale of speech signals in accordance with the invention.

Referring now to FIG. 4, which illustrates a routine for speeding up the time scale of speech signals, it is first determined, at step 150 whether the next two groups of samples are to be combined to form a combined group and then the combined group reproduced in place of the next two groups. If not, the next group of samples is reproduced at the normal rate (step 152). It should l,e understood that the group of samples consists of the number of samples tha is equal to the number of samples estimated to constitute a pitch period. The group may therefore be said to represent a pitch period.

Following step 152 is step 154, at which the routine of FIG. 4 updates the number of samples considered to represent a pitch period. This number will sometimes be referred to as "P" and is equal to the most recent estimate provided at step 130 of FIG. 3. (It will therefore be observed that the number of samples reproduced at step 152, just discussed above, was equal to the value of P in effect at the time of step 152.) Following stap 154 is step 156, at which it is determined whether the desired playback of the speech signals has been completed. If so, the routine ends. If not, the routine returns to step 150.

If at step 150 it was determined that the next pair of pitch periods is to be combined and the resulting combined period reproduced in their stead, then step 158 follows at which the rate at which samples are taken in from decoder module 26 is doubled. The doubled take in of samples continues for as long as would have been required to take in P samples at the normal rate for taking in samples. Accordingly $2 \times P$ samples are taken in, consisting of two sequential groups of P samples each. Each group may be considered to represent a pitch period.

Of these two groups of samples, the first group will be referred to as group N or pitch period N, while the second group will be referred to as group N+1 or pitch period N+1.

After step 158, the routine then proceeds to step 160, at which the samples of group N are reproduced at the normal rate and the samples of group N+1 are stored in a buffer.

Next follows step 162 at which another group of P samples (group or pitch period N+2) is taken in from decoder module 26. Group N+2 is combined with group N+1 to form a combined group C. Group C is then reproduced, i.e. passed through modules 30, 14 and 32 of FIG. 2 (step 164), and the routine then proceeds to steps 154 and 156, which have previously been described.

It will be noted that the effect of steps 160, 162 and 164 has been to output combined group C instead of groups N+1 and N+2, from which group C was formed. The way in which groups N+1 and N+2 are combined to form group C will be discussed in more detail below.

It will be noted that for a scaling factor of 0.666 (i.e. a sequence of normal reproduction for one pitch period, replacement of the next two periods with a combined period, then normal reproduction for one period, and replacement of the next two with a combined pitch period, etc.), the routine of FIG. 4 never branches to step 152. Rather, the routine would continuously cycle from step 150 to step 158 etc. and back to step 150.

If the requested scaling factor were 0.75, the routine would alternate in branching to steps 152 and 151 from step 150. In other words, each time step 150 was reached it would be determined whether the last branching from step 150 was to step 152, and if so the routine would branch to step 158; otherwise, it would branch to step 152.

Similarly, if a scaling factor of 4/5 were requested, the routine would repeat a cycle of branching twice to step 152 and then once to step 158. Again, in other words, at step 150 it would be determined whether the last two branches had been to step 152, and if so the routine would branch to step 158; otherwise, it would branch to step 152.

Turning now to the time scale slowdown routine illustrated on FIG. 5, the basic approach may be summarized as follows:

A group of samples representing a pitch period is reproduced at the normal rate. That group of samples is then combined with the next sequential group of samples to form a combined group. The combined group is then reproduced. Then the next group, which had been used along with the first group to form the combined group, is reproduced at the normal rate.

It will be seen that the total elapsed time between the beginning of the reproduction of the first group and the reproduction of the next sequential group is twice that required for normal production of the first group. Thus one can say that a scaling factor of 2.0 has been applied to the time scale of the first group.

A lower scaling factor, representing a somewhat less slowed down time scale, can be achieved by, for instance, reproducing two pitch periods at a normal rate, and then combining the second pitch period with the next sequential (i.e. third) pitch period and reproducing the combined pitch period. The third and fourth groups are then reproduced and a combined group formed from the fourth and fifth pitch period is then reproduced, and so forth. It will be seen that a scaling factor of 1.5 is thereby obtained.

Figure 5:
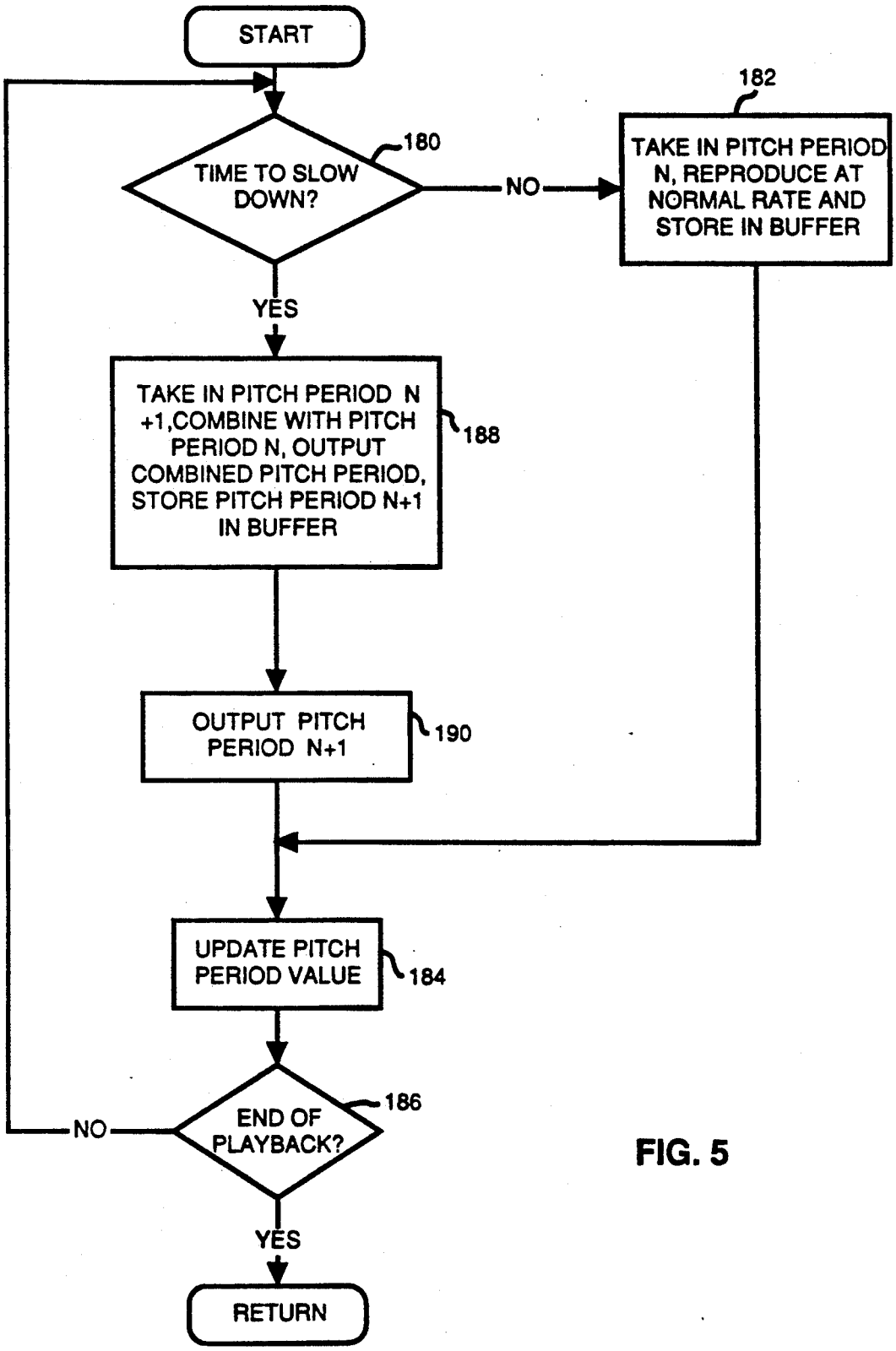
FIG. 5 is a flowchart illustrating a program for slowing down the time scale of speech signals in accordance with the invention.

Turning now to a more detailed discussion of the routine of FIG. 5, the routine begins with step 180, at which it is determined whether a combined pitch period is to be inserted after the reproduction of the group of samples most recently taken in from module 26 and reproduced. If not, step 182 follows, at which the next group (which will be called N) is taken in and reproduced at the normal rate and stored in buffer 28. Step 184 then follows, at which the routine updates the number of samples considered to represent a pitch period. After step 184 is step 186, at which it is determined whether the desired playback of speech signals has been completed. If so, the routine ends. If not, the routine returns to step 180.

If at step 180 it was determined that a combined pitch period is to be inserted after the most recently reproduced pitch period taken in from module 26, the routine proceeds to step 188.

At step 188, the next group or pitch period (which will be called N+1) is taken in from module 26 and combined with group N (which is assumed to have been stored in a buffer) to form combined group C, which is then output. Group N+1 replaces group N in the buffer. To be more precise, as each sample of group N+1 is taken in, it is combined with a corresponding sample of group N to form a corresponding combined sample of combined group C, the combined sample is reproduced, and that sample of group N+1 then replaces the corresponding sample of group N in the buffer. Combination of the samples of groups N and N+1 to form combined samples of group C will be described in more detail below.

Following step 188 is step 190, at which the samples of group N+1 are reproduced at the normal rate. The samples of group N+1 then remain in the buffer until the next branching through step 182 or step 188.

Following step 190, the routine prcceeds to steps 184 and 186, which have previously been described.

It should be noted that if a slowdown scaling factor of 2.0 is selected, the routine of FIG. 5 would never branch to step 182. Rather, each time it reaches step 180 it would pass through steps 188 and so forth. It should further be noted that in such a case, the pitch period N+1 of steps 188 and 190 on a first cycle through steps 188 etc. would be considered to be pitch period N for the purpose of step 188 on the next cycle through steps 188 and 190.

If the user selects a slowdown scaling rate of 1.5, the routine will alternately branch from step 180 to step 182, then step 188 then step 182, then step 188, etc. Again, it should be noted that in such a sequence, upon a branch to step 182 the "next pitch period" to be reproduced will be the same as the pitch period N+1 from the latest cycle through step 190.

In a preferred approach to the invention, the following slowdown scaling rates are available to the user: 2.0 (2 divided by 1), 1.5 (3/2), 1.333 (4/3), 1.25 (5/4), 1.2 (6/5), 1.166 (7/6), 1.142 (8/7). Smaller slowdown scaling factors then 1.5 may achieved by increasing the ratio of cycles through step 182 to cycles through steps 188 etc. When a scaling factor greater than 1.0 has been applied to the stored speech signals, it may be said that the time scale of the signals has been "expanded".

At step 164 of FIG. 4 and step 190 of FIG. 5, reference was made to combining two sequential groups of samples to perform a combined group of samples. This process will now be described in more detail with reference to FIGS. 6-A, 6-B and 6-C.

FIG. 6 schematically shows group G consisting of P samples. Also shown is the next sequential group G+1 of P samples. A descending ramp function D is applied to the samples S of group G and an ascending ramp function A is applied to the samples S of group G+1. After application of the respective functions, the samples are combined to produce P combine samples S' which then make up combined group C.

For i greater than or equal to 1 and less than or equal to P, $S'_i = S_{iG} \times D(i) + S_{iG}+1 \times A(i)$, where $S'_i$ is the ith sample in group C, $S_{iG}$ is the ith sample of group G, $S_{iG}+1$ is the ith sample of G+1, and D (i) P−i divided by P−1 and A (i)=1−D (i). It will be observed that function D is a descending ramp function and function A is an ascending ramp function.

It will be further noted that for values of i close to zero, $S^1_i$ is close to $S_{iG}$ and that for values of i close to P, $S^1_i$ is close to $S_{iG}+1$. Thus descending ramp function D weights group C so that the first part of group C resembles the first part of group G, while ascending ramp function A weights group C so that the latter part of group C resembles the latter part of group G+1.

FIG. 6-B schematically illustrates formation of a combined group C as performed in connection with the time scale compression routine of FIG. 4. As indicated by FIG. 6-B, group N is reproduced, combined group C is formed by applying descending ramp function D to group N+1 and ascending ramp function A to group N+2. Group C is reproduced and then group N+3 is reproduced. Groups N+1 and N+2 of FIG. 6-B respectively correspond to groups G and and G+1 of FIG. 6-A. Groups N, N+1 and N+2 of FIG. 6-B also correspond to the groups of the same names of steps 160 and 162 of FIG. 4; group C of FIG. 6-B corresponds to the combined group output at step 164 of FIG. 4; Group N+3 of FIG. 6-B corresponds either to group N of the next branch through step 160 or to the group reproduced at the next branch through step 152, as the case may be.

FIG. 6-C schematically illustrates formation of a combined group C as performed in connection with the time scale expansion routine of FIG. 5. As indicated by FIG. 6-C, group N is reproduced, combined group C is formed by applying descending ramp function D to qroup N+1 and ascending ramp function A to group N. Group C is reproduced and then group N+1 is reproduced. Groups N and N+1 of FIG. 6-C respectively correspond to groups G+1 and G of FIG. 6-A. Groups N and N+1 of FIG. 6-C also correspond to the groups of the same name of steps 188, 190 of FIG. 5.

It will be noted that group C of Fiq. 6-B is formed so that its beginning smoothly blends with the end of group N and its end smoothly blends with the beginning of group N+3. Similarly, group C of FIG. 6-C is formed so that its beginning smoothly blends with the end of group N and its end smoothly blends with the beginning of group N+1.

Although linear ramp functions D and A are preferred, it will be recognized that other functions, such as nonlinear ramps, could be instead used to form combined group C.

Steps 122 and 130 of FIG. 3, which relate to the measurements and batch processing for pitch estimation, will now be discussed in more detail. The method of this invention makes use, with some modifications, of the known pitch estimation algorithm that is sometimes referred to the parallel processing or Gold algorithm. The parallel processing pitch estimation algorithm is described in B. Gold and L. Rabiner, "Parallel Processing Techniques for Estimating Pitch Periods of Speech in the Time Domain", J. Acoust. Soc. Am, VOL. 46, pages 442–448, AUG. 1969 (sometimes referred to herein as the "Gold article") and is also discussed in L. R. Rabiner, N. J. Cheng, A. E. Rosenberg, and C. A. McGonegal, "A Comparative Performance Study of Several Pitch Detection Algorithms" IEEE Transactions on Acoustics, Speech and Signal Processing, Volume ASSP-24, no. 5, pages 399 to 418, October 1976.

As described in more detail in the Gold article, the parallel processing pitch estimation alqorithm includes filtering of the speech signal, making six series of measurements of the weigh form of the speech signal, applying each of those six series of measurements to one of six pitch period estimators working in parallel and then comparing the results of each of the pitch period estimators to arrive at a final estimate. The measurements, as shown on FIG. 2 of the Gold article, are related to the peaks and valleys of the speech signal wave form.

As will be appreciated by those skilled in the art, the filtering, the measurements, the six parallel pitch period estimators and the comparison of the outputs of the pitch period estimators, can all be realized by use of a single processor operating under the control of the suitable stored program. The above mentioned NEC model 77P25 is such a processor. Provision of such a program is well within the ability of those skilled in the art.

Although a preferred approach to this method utilized six pitch period estimators as described in the Gold article, it is within the contemplation of this invention to use a larger or smaller plurality of pitch period estimators.

The portion of the program for pitch estimation relating to sample by sample measurements is represented by step 122 of FIG. 3. The balance of the program is represented at step 130 of FIG. 3.

As implemented in connection with this invention, the parallel processing pitch estimation algorithm described in the Gold article was modified, as suggested in that article, to use only a single set of coincidence measurements, based on differences and period rather than ratios. (See the Gold article at page 447, numbered paragraph 3). An additional modification was made to Gold's algorithm in order to prevent false detection of peaks and valleys. This modification took the form of a routine that tested each detected peak to insure that it was above zero and tested each valley to insure that it was below zero.

It was also found desirable to make a further modification to the algorithm of the Gold article to accommodate those situations in which it was necessary to conserve the amount of processing time spent on pitch estimation. This modification is described with reference to FIG. 7, which illustrates a routine for conserving pitch estimation processing time.

Figure 7:
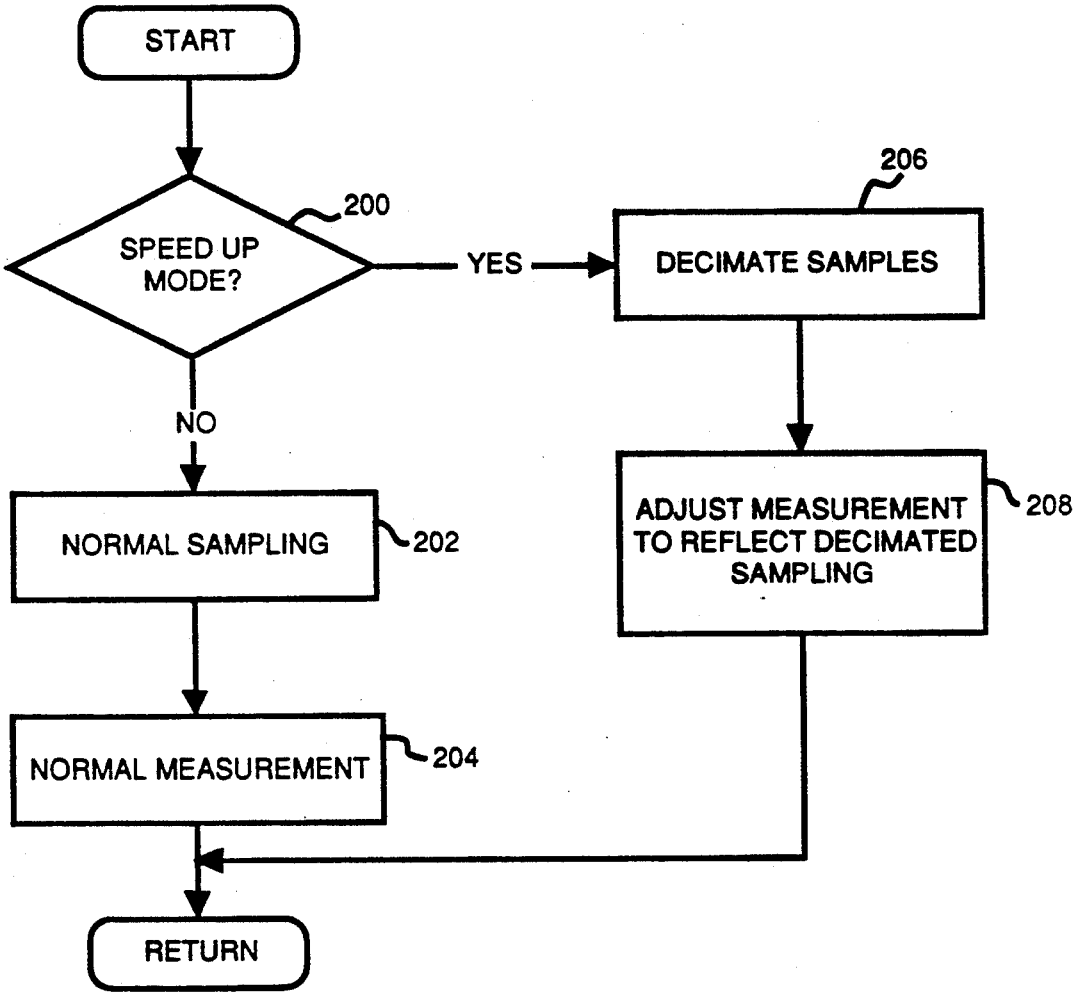
FIG. 7 is a flowchart that illustrates in greater detail a portion of the program of FIG. 3 relating to measurements for pitch estimation.

The routine of FIG. 7 begins with step 200, at which it is determined whether the program is passing through the branch of FIG. 4 which includes steps 158 through 164. It will be recalled that these steps resulted in the substitution of a combined pitch period for two stored pitch periods. This branch will sometimes be referred to as the "speed up mode" of the program.

If it is determined that step 200 that the speed up mode is not taken place, step 202 follows, in which, as normally occurs, each sample is used for the purpose of making the pitch estimation measurements. The routine then proceeds to step 204, at which the measurements are carried out in the normal way as described in the Gold article.

However, if at step 200 it is determined that the program is in speed up mode, every other sample is dropped from consideration for the purpose of pitch estimation (step 206). This dropping of every other sample is sometimes referred to as "decimation". Now, in order to reflect the fact that the samples have been decimated, it is necessary to adjust the measuring process described in the Gold article by doubling the blanking times and the exonencial decay periods (as measured in samples) described in the Gold article. (See FIG. 4 of the Gold article). This adjustment to the measurement process is reflected by step 208 of FIG. 7.

Although the decimation of samples and adjustment of the measuring procedure has some adverse effect on the accuracy of the pitch estimation, that adverse effect has been found to be acceptably small. Although it is a preferred feature of this invention to decimate samples only when the program is in speed up mode, it is within the contemplation of this invention always to decimate samples. It is also within the contemplation of this invention to dispense entirely with decimation by, for example, using a faster processor.

Returning now to the question of when batch processing for pitch estimation is performed (step 130 of FIG. 3), it will be noted that the sample count is incremented (step 111, FIG. 3) each time a sample is played back. As noted previously, this will occur in playback mode every 125 microseconds. Once the sample count has reached 40 (step 126) the background branch of the program of FIG. 3 (steps 128 and 130) is actuated, resulting in resetting of the sample count and performance of the branch processing. The effect of steps 111, 126 and 128 is therefore to initiate a new process of pitch estimation every 5 miliseconds during playback ($40\times125$ microseconds). This has been found to be sufficiently frequent, given that a period of 20 milliseconds during speech is essentially considered to represent no change in the characteristics of the speech signal.

The method of time scale modification disclosed and described herein has been found to result in high quality reproduction of the time scale modified speech signals with efficient use of processing resources and memory. In particular, less than 175 sixteen bit words of RAM were required for the pitch estimation, combining of pitch periods and data buffering used in this method.

Those skilled in the art will recognize that the combining of pitch periods, according to this invention and at the scaling rates disclosed, requires buffering of only p samples, where "p" is the number of samples making up a pitch period. By contrast, the time scale modification approach in the Cox et al. article (cited above) require buffering of $2\times p$ samples. The Cox et al. also results in less efficient processing than the method of this invention. This is due, at least in part, to the fact that Cox et al. use a "window" that varies both with pitch period and scaling rate. In the method of this invention, however, the number of samples in the two groups to be combined always equals a pitch period, regardless of which scaling rate is selected.

Although the preferred scaling rates described herein range from, 0.666 (greatest compression) to 2.0 (greatest expansion), it is within the contemplation of this invention to achieve still greater compression or expansion by iterating or modifying the inventive method or combining it with other time scale modification approaches. For example, greater compression or expansion could be achieved by repeating or dropping stored pitch periods, as per the Neuberg article or U.S. Pat. No. 3,104,284 (cited above).

As another example, a scaling rate of 0.5 may be achieved with buffering of no more than $p+1$ samples by use of a modified time scale compression algorithm. In the modified algorithm, a pair of samples from the buffer is combined to form a combined sample which is then output. The remaining samples within the buffer are shifted to open a pair of storage locations at the end of the buffer. The next two samples to be loaded from the disc storage are then inserted into the newly opened storage locations. These steps are then repeated as long as a 0.5 scaling rate is desired.

Further, although it is a preferred aspect of the invention to use the parallel pitch estimation technique as per Gold et al., with modifications as described herein, it is also within the contemplation of this invention to dispense with those modifications or to substitute another pitch estimation technique.

As will be appreciated by those skilled in the art, a number of variations and modifications may be made to the present invention without departing from the true spirit and scope thereof. It is therefore intended that the following claims cover each such variation and modification.

What is claimed is:

1. A method of modifying the time sacle of speech signals, said signals representing a wave form having a given pitch period and comprising a sequence of samples, the method comprising the steps of:

(a) storing said sequence of samples in a memory;

(b) retrieving said stored samples from said memory;

(c) estimating a number of said retrieved samples that constitutes a pitch period of said signals;

(d) reproducing a plurality of gorups of said retrieved samples in the form of audible speech with each of said groups consisting of said estimated number of samples;

(e) combining a first group of said retrieved samples with a second group of said retrieved samples to form a combined group of said estimated number of samples, said second group immediately following said first group in said sequence of samples; and (f) reproducing said combined group in the form of audible speech.

2. The method of claim 1, further comprising the steps of:

(g) reproducing said first group in the form of audible speech at normal speed before step (f); and (h) reproducing said second group in the form of audible speech at normal speed after step (f);

whereby the time scale of said first and second groups is expanded.

3. The method of claim 1, wherein said first and second groups are not reproduced n the form of audible speech, and said combined group is reproduced instead of said first and second groups, whereby the time scale of said first and second groups is compressed.

4. The method of claim 1, wherein said estimating step comprises making peak and/or valley measurements of said wave form, said estimating being performed by use of a plurality of pitch estimators operating in parallel and processing said peak and/or valley measurements.

5. The method of claim 4, further comprising the steps of decimating said samples before making said measurements.

6. A method of modifying the time scale of speech signals, said signals representing a wave form having a given pitch period and comprising a sequence of samples, the method comprising the steps of:

(a) storing said sequence of samples in a memory;

(b) selecting a scaling rate for reproduction of said signals from among a predetermined plurality of scaling rates; and (c) reproducign said signals from said stored sequence fo samples in audible form in accordance with said selected scaling rate; wherien, if said selected scaling rate is other than 1.0, said step (c) comprises the substeps of:

(i) estimating a number of said samples that constitutes a pitch period of said signals;

(ii) combining a first group of said samples with a second group of said samples to form a combined group of said estimated number of samples, said second group immediately following said first group in said sequence of samples; and (iii) reproducing said combined group in the form of audible speech.

7. The method of claim 6, wherein, if said selected scaling rate exceeds 1.0, said step (c) further comprises the substeps of:

(iv) reproducing said first group in the form of audible speech at a scaling rate of 1.0 before said substep (iii); and (v) reproducing said second group in the form of audible speech at a scaling rate of 1.0 after said substep (iii);

whereby the time scale of said first and second groups is expanded.

8. The method of claim 6, wherein if said selected scaling rate is less than 1.0, said step (c) comprises not reproducing said first and second groups in the form of audible speech, said combined group being reproduced instead of said first and second groups, whereby the time scale of said first and second groups is compressed.

9. The method of claim 6, wherein said estimating substep comprises making peak and/or valley measurements of said wave forms, said estimating being performed by use of a plurality of pitch estimators operating in parallel and processing said peak and/or valley measurements.

10. The method of claim 9, further comprising the step of decimating said samples before making said measurements.

11. A method of modifying the time scale of speech signals, said signals representing a wave form having a given pitch period and comprising a sequencde of samples, the method comprising the steps of:

(a) storing said sequence of samples in memory;

(b) requesting reproduction of said signals;

(c) selecting a scaling rate for reproduction of said signals from among a predetermined plurality of scaling rates;

(d) estimating a number of said samples that constitutes a pitch period of said stored signals; and (e) reproducing said signals from said stored sequence of samples in audible form in accordance with said selected scaling rate; the method further comprising teh following steps is said selected scaling rate exceeds 1.0:

(f) reproducing in audible form at a scaling rate of 1.0 a seuqence of groups of said samples, said sequence consisting of n groups of samples, n being a positive integer and being a function of said selected scaling rate, each of said groups consisting of a number of sequential samples, said number being equal to said estimated number, said sequence comprising a last group;

(g) combining said last group with another group of samples, to form a combined group, said another group also consisting of said estimated number of samples, said another group immediately following said last group;

(h) reproducign said combined group in the form of audible sound; and (i) repeating steps (f), (g) and (h) until said requested reproduction is complete; the method further comprising the following steps if said selected scaling rate is less than 1.0:

(j) reproducing in audible form at a scaling rate of 1.0 a sequence of groups of said samples, said sequence consisting of m groups of samples, m being a positive integer and being a function of said selected scaling rate, each of said groups consisting of a number of sequential samples, said number being equal to said estimated number, said sequence comprising a last group;

(k) combining a first following group with a second following group to form a combined group of samples, said first and second groups each consisting of said estimated number of samples, said first group immediately following said last group, said second group immediately following said first group;

(l) not reproducing said first and second groups and reproducing said combined group in the form of audible sound in place of said first and second groups; and (m) repeating steps (j), (k) and (l) until said requested reproduction is complete.

12. The method of claim 11, wherien said predetermined plurality of scaling rates comprsies one or more scaling rates chosen from the group consisting of 0.666, 0.75, 0.8, 0.833, 0.857, 0.875, 1.142, 1.166, 1.2, 1.25, 1.333, 1.5 and 2.0.

13. The method of claim 12, wherein said step (g) comprises applying a descending ramp function to said another group to produce a first set of adjusted samples, applying an ascending ramp function to said last group to produce a second set of adjusted samples, and adding each sample of said first set of corresponding sample of said second set to produce said combined group of samples.

14. The method of claim 13, wherein said step (k) comprises applying said descending ramp function o said first group to produce an initial set of adjusted samples, applying said ascending ramp function to said second group to produce a subsequent set of adjusted samples, and adding each sample of said initial set to a corresponding sample of said subsequent set to produce said combined group of samples.

15. The method of claim 14, wherein said estimating step comprises making peak and/or valley measurements of said wave form, said estimating being performed by use of a plurality of pitch estimators operating in parallel and processing said peak and/or valley measurements.

16. The method of claim 15, further comprising the step of decimating said samples before making said measurements.

17. An apparatus for storing and reproducing speech signals, comprising:

a memory;

means for storing said signals in said memory in the form ofa sequence of samples;

means for retrieving said samples from said memory;

means for reproducing speech signals in the form of audible speech; and a processor connected to said memory, said storing means, said retrieving means and said reproducing means, said processor being programmed to:

(a) cause said storing means to store said signals in said memory;

(b) cause said retrieving means to retrieve said samples from said memory;

(c) estimate a number of said retrieved samples that constitutes a pitch period of said signals;

(d) cause said reproducing means to reproduce a group of said retrieved samples, said group consisting of a number of samples, said number being equal to said estimated number;

(e) after step (d), combine a first group of said retrieved samples with a second group of said retrieved samples to form a combined group, said first group and second group each consisting of a same number of sequential samples, said same number being equal to said estimated number, said second group immediately following said first group in said sequence of samples; and (f) cause said reproducing means to reproduce said combiend group.

* * * * *